US006494780B1

(12) United States Patent
Norbury, Jr.

(10) Patent No.: US 6,494,780 B1
(45) Date of Patent: Dec. 17, 2002

(54) LOUVER WITH SLIDABLE FACE PLATE

(75) Inventor: Raymond L. Norbury, Jr., Dallas, TX (US)

(73) Assignee: Cary Products Company, Inc., Hutchins, TX (US)

( * ) Notice: Subject to any disclaimer, the term of this patent is extended or adjusted under 35 U.S.C. 154(b) by 0 days.

(21) Appl. No.: 09/953,066

(22) Filed: Sep. 14, 2001

(51) Int. Cl.[7] ..... F24F 13/06
(52) U.S. Cl. ..... 454/319; 454/155; 454/315
(58) Field of Search ..... 454/109, 155, 454/313, 315, 318, 319, 320

(56) References Cited

U.S. PATENT DOCUMENTS 3,680,470 A * 8/1972 Neece ..... 454/313
5,469,658 A * 11/1995 Digianni et al. ..... 160/176.1 R
5,722,883 A * 3/1998 Schwarz ..... 454/155
6,314,680 B1 * 11/2001 Buckwalter et al. ..... 49/74.1

FOREIGN PATENT DOCUMENTS

DE 100 07 965 * 8/2001
JP 59-18011 * 1/1984

* cited by examiner

*Primary Examiner*—Harold Joyce
(74) *Attorney, Agent, or Firm*—David W. Quimby

(57) ABSTRACT

A louver with a slidable face plate may be used to direct fluid flowing through the louver in a desired direction (e.g. right or left) Vanes of the louver may include pinions that couple to rack gears of a housing and a face plate. Sliding the face plate may rotate louver vanes so that fluid flowing through the louver is directed in the desired direction. The face plate may also be rotatively mounted to the housing so that the face plate has a limited amount of rotational movement. Rotating the face plate may allow control of direction of fluid flow through the louver in directions other than the direction controlled by sliding the face plate (e.g. up and down).

37 Claims, 9 Drawing Sheets

LOUVER WITH SLIDABLE FACE PLATE

BACKGROUND OF THE INVENTION

1. Field of Use

This invention relates generally to air conditioning systems, and more particularly to a louver for directing and maintaining air flow from a vent in a desired direction.

2. Description of Related Art

Louvers may be used to direct and control fluid flow from a system in a desired direction. Louvers may also control an amount of fluid that flows from the system. Louvers may be used in an automobile ventilation system to control the direction that air flows when the air exits the ventilation system. Louvers may be used in building ventilation systems. Louvers may also be used in a number of other applications, including but not limited to, controlling an amount of light that enters a window or aperture, and controlling liquid flow through a system.

A louver may include a number of louver vanes that allow fluid passing through the louver to be directed in a desired direction (e.g., right or left, or up and down). Louvers may include a mechanism that allows the direction of the vanes to be simultaneously adjusted. Typical mechanisms require that the vanes of the louver include linking structure that allows all of the vanes to simultaneously move when an actuator is moved. One type of louver includes a wheel actuator. Another type of louver includes a lever actuator. When the actuator is rotated (a wheel actuator) or moved (a lever actuator) the directional position of louver vanes are changed. The linking structure may require that the vanes be placed within a louver body in a particular order. The need for particular vane structures may increase complexity, assembly cost, and number of individual parts needed to form the louver.

A louver may include a mechanism that allows the louver to be rotated so that fluid flowing through louver is directed in a first or second direction (e.g., up and down, or right and left). Typically, a rotational portion of the louver allows control of air flow in a direction that is substantially perpendicular to control of air flow provided by positional adjustment of louver vanes. For example, if louver vanes allow air flow to be adjusted in a left and right direction, a rotational portion of the louver may allow the air flow to be controlled in an up and down direction. In some louver embodiments, such as louvers for building ventilation systems, louvers may not include rotational portions.

A louver with a rotational portion may include projections and grooves on mating rotational and stationary portions of the louver. The projections and grooves may provide interlocking engagement that holds the rotational portion of the louver in a fixed position relative to the stationary portion of the louver. The interlocking engagement may inhibit unintentional movement of the rotational portion of the louver due to vibrational forces or other forces applied to the louver. U.S. Pat. No. 5,538,470 issued to Norbury et al., which is incorporated by reference as if fully set forth herein, describes a louver with a rotational portion that interlocks with a stationary portion.

SUMMARY OF THE INVENTION

A louver may be used to diffuse and direct fluid exiting a vent of a ventilation system in a desired direction. A louver may include a rack and pinion system. The rack and pinion system may allow louver manufacturers to mold or machine louver components that are easy to assemble. Louvers that utilize rack and pinion systems may have fewer individual parts than conventional louver designs. The components of a louver may be easily, quickly and efficiently assembled together to produce a louver.

In a louver embodiment, the louver includes a face plate or bezel, a first housing, louver vanes and a second housing. The face plate and the first housing may include rack gears that engage pinions of the louver vanes when the face plate and first housing are joined together.

In a louver embodiment, the louver includes a face plate, a first housing, and louver vanes. The louver vanes include axles that fit within holders. The holders may be, but are not limited to, recesses or retainers of the first housing. The face plate includes at least one rack gear that engages pinions of the louver vanes. When the face plate is laterally moved relative to the first housing, the rack gear rotates the pinions so that the louver vanes rotate. In an alternate embodiment, axles of louver vanes are placed within holders in the face plate. The holders may be, but are not limited to, recesses or retainers. The first housing includes a rack gear that engages pinions of the louver vanes. When the face plate is laterally moved relative to the first housing, the rack gear rotates the pinions so that the louver vanes rotate. As the vanes rotate, the vanes laterally translate along with the face plate.

Conventional louver designs typically include linking structures attached to louver vanes that allow the vanes to simultaneously move when a wheel, lever or other actuator is engaged. The connecting links may require that each vane of the louver be different from other vanes. The connecting links may make assembling a louver difficult and/or time consuming. The use of a rack and pinion system to allow simultaneous movement of louver vanes may allow a face plate of the louver to be the actuator of the louver. The use of the face plate as the actuator provides a large surface for a user to contact so that a user may contact and adjust the louver without needing to visually check operation of the louver.

Elimination of a separate component actuator from a louver design may expand possibilities of face plate styles. The use a face plate to control positions of louver vanes may remove design restrictions that limit face plate styles of conventional louvers due to space restrictions associated with louver vane actuators and linking structures. Various grid patterns in conjunction with a crown, dome, flat, square, round, oval or other style of face plate body may be used. The face plate may be free of vane actuator mechanisms that protrude from the plate and mar or otherwise influence the aesthetic appearance of the louver and system to which the louver is attached.

Use of a rack and pinion system of louver movement may allow all louver vanes of the louver to be substantially identical. Having substantially identical louver vanes may simplify the louver design, may reduce inventory requirements, and may reduce time and labor needed to assemble louvers. The simplified louver design may reduce the possibility of louver failure. The louver vanes may include domed surfaces that contact other louver body surfaces to inhibit rattling of the vanes due to vibration during use.

An advantage of the louver is that a frame of the louver is used to change the directional flow of forced air through the louver. An external face of the louver is the activation mechanism of the louver. The louver requires no connecting link mechanism to each vane or separate component actuator that extends above the louver face to allow for adjustment of vane position. The face provides a user with a large surface to contact or grasp when the user adjusts the position of the louver vanes.

Another advantage of the louver is that each louver vane may be substantially identical to other louver vanes. Having substantially identical louver vanes may reduce the number of distinct parts needed to assemble a louver, may simplify assembly of the louver, and may reduce assembly time needed to form a louver. The reduction of the number of distinct parts needed to produce a louver may simplify and reduce the expense of molds that produce the components of the louver. In some louver embodiments, louver vanes may not be identical. For example, in a louver embodiment, end louver vanes have wider blades than central vanes of the louver so that the end vanes contact surfaces of a louver housing when a face plate of the louver is fully extended in a first or second direction. The ability to use louver vanes of varying widths may allow for the use of louver vanes that are sized to fit a louver of a specific length with a louver that has a longer length.

An advantage of the louver is that the louver may have a position indicator that indicates when the louver is in a reference position. Typically, the reference position indicates when a face plate of the louver is at, or substantially at, a mid-point position relative to an unmovable portion of the louver or relative to an opening in a ventilation system. When the position indicator is in an engaged position, the louver vanes may be positioned substantially perpendicular to a rack of the louver so that fluid flow through the louver is directed substantially straight out of the louver. In some embodiments, movement of a face plate of the louver may allow vanes of the louver to be closed or substantially closed to inhibit fluid flow through the louver. In some embodiments, the louver vanes may be moved to a closed position by linearly moving a face plate fully away from the engaged position in a first direction or in a direction that is opposite to the first direction. Some louver embodiments may include position indicators that are not located at or substantially at a mid-point position of the face plate.

Further advantages may include that the louver is sturdy, strong, compact, durable, light-weight, simple, safe, efficient, versatile, ecologically compatible, energy conserving, and reliable; yet the louver may also be easy to manufacture, install, operate and maintain.

BRIEF DESCRIPTION OF THE DRAWINGS

Further advantages of the present invention will become apparent to those skilled in the art with the benefit of the following detailed description of the preferred embodiments and upon reference to the accompanying drawings in which.

Figure 1:
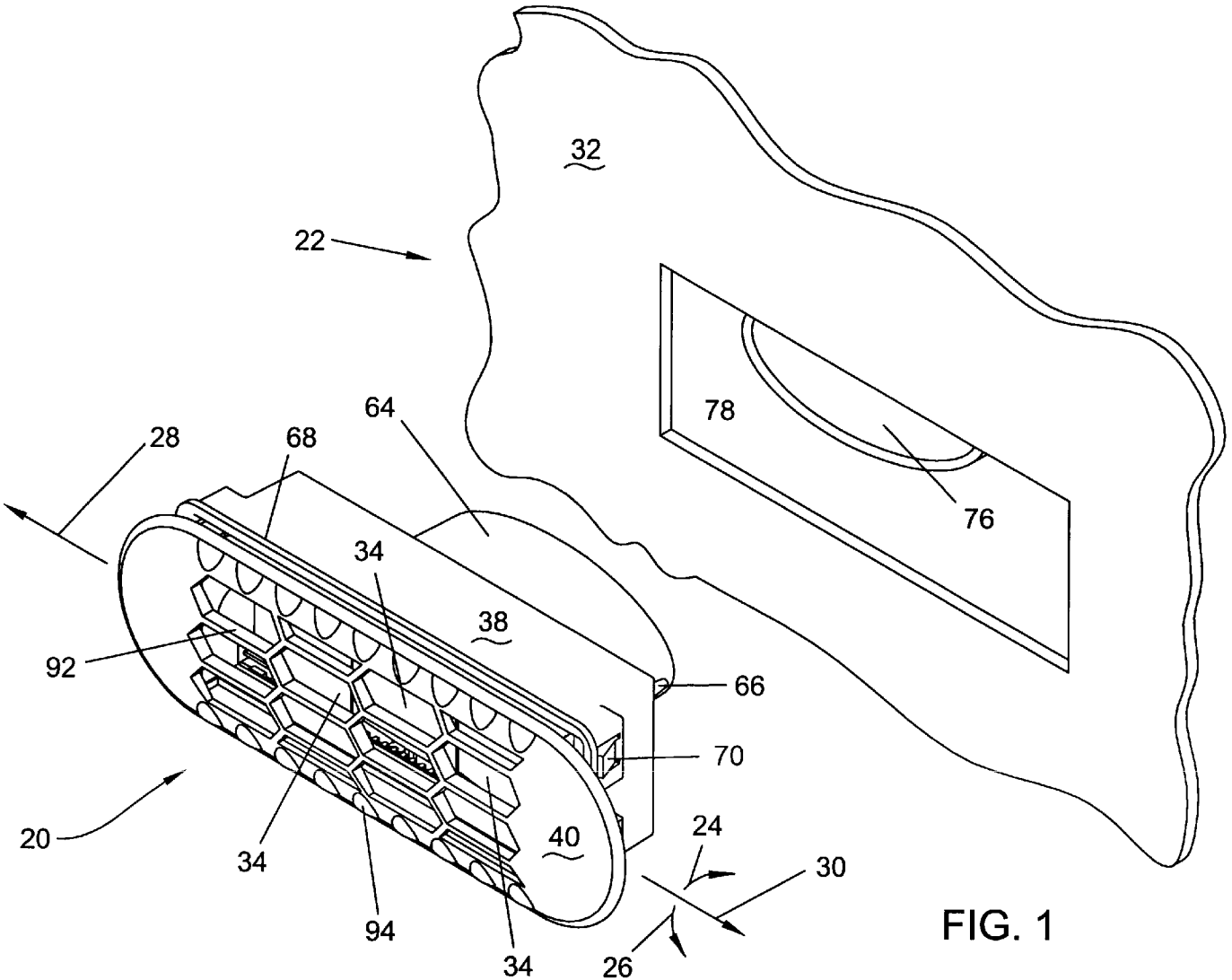
FIG. 1 shows a perspective view of an embodiment of a louver prior to coupling the louver to a ventilation system.

While the invention is susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION OF THE PREFERRED EMBODIMENTS

Referring to the drawings, and more particularly to FIG. 1, a louver is designated generally as 20. A louver 20 may direct fluid flowing out of a vent of a ventilation system 22 in a desired direction. In an embodiment of a louver 20, the direction of fluid flow out of the louver is adjusted by moving a face plate of the louver in first direction 24, second direction 26, third direction 28 and/or fourth direction 30. The first direction 24 and second direction 26 may be normal to the third direction 28 and the fourth direction 30. The louver 20 may be coupled to a structure 32. The ventilation system 22 may any type of ventilation system such as, but not limited to, a ventilation system of an automobile, building, or machine. The fluid may be any type of fluid such as, but not limited to, air, nitrogen, oxygen, carbon dioxide, steam, or water. In an embodiment, the ventilation system 22 is a ventilation system of an automobile, and the fluid is forced air.

Figures 2, 3:
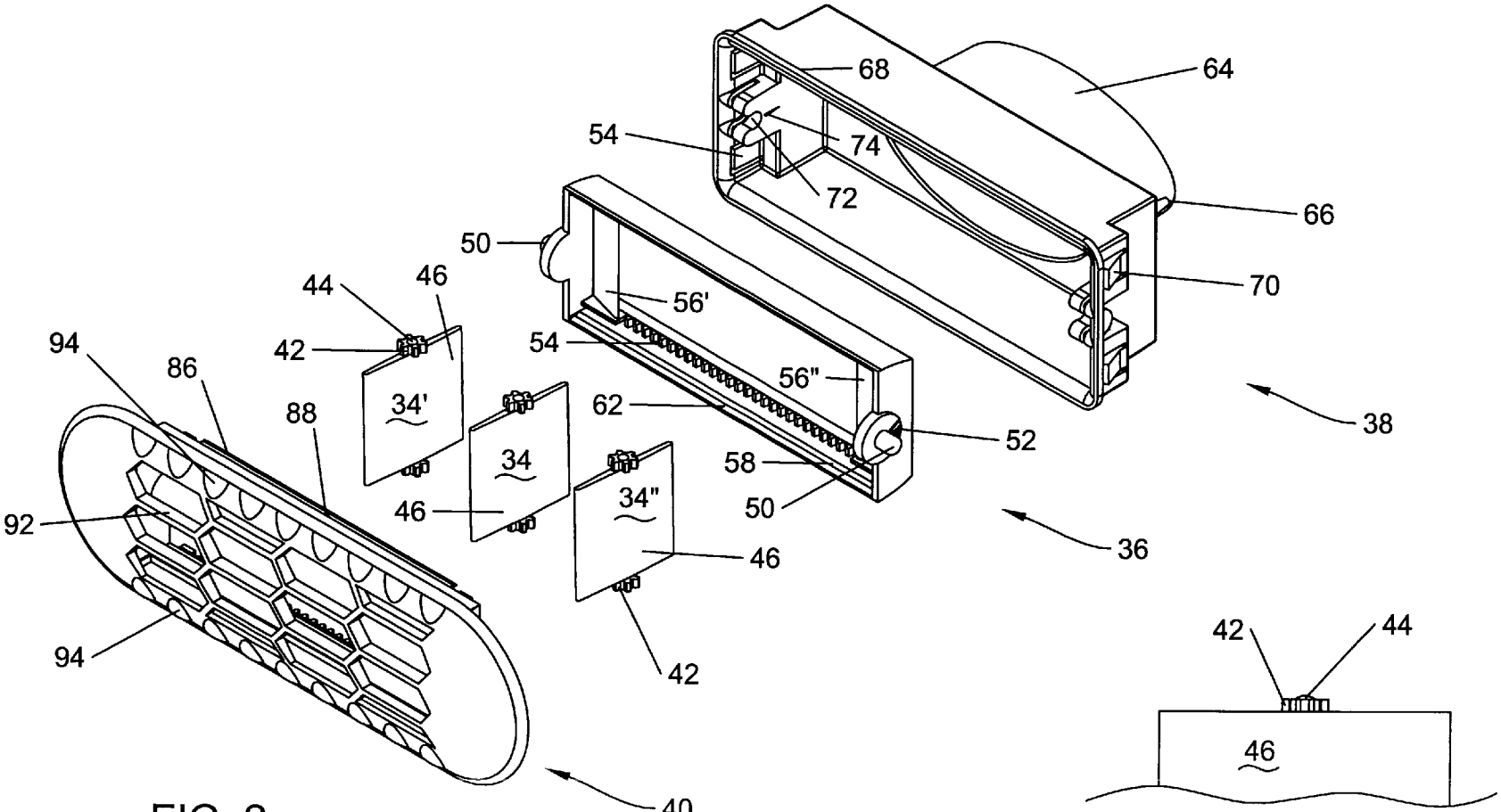
FIG. 2 shows an exploded view of an embodiment of a louver.
FIG. 3 shows a front view of a portion of an embodiment of a louver vane.

FIG. 2 shows an exploded view of the embodiment of a louver 20 depicted in FIG. 1. The louver 20 may include louver vanes 34, first housing 36, second housing 38, and face plate 40. The louver vanes 34 may direct fluid flowing through the louver 20 in a desired direction. The first housing 36 may be rotatively coupled to the second housing 38 so that the louver 20 can be adjusted in a first direction 24 and second direction 26 when the face plate 40 is moved in the first or second direction (directions shown in FIG. 1).

The second housing 38 may attach to a structure 32 through which fluid flowing in a ventilation system 22 passes. In an embodiment, the first direction 24 is up and the second direction 26 is down. The louver vanes 34 may be coupled to the first housing 36 and to the face plate 40. The face plate 40 may be moved in a third direction 28 or fourth direction 30 to adjust the position of the louver vanes 34 and the direction of fluid flow out of the louver 20. In an embodiment, the third direction is left and the fourth direction is right relative to the second housing 38. In the embodiment shown in FIG. 2, the louver vanes 34 are oriented substantially perpendicular to face plate 40 to allow fluid flow directed through the louver 20 to flow substantially straight out of the face plate. The louver 20 shown in FIG. 2 would be in a fully open position if the components were joined together. In the louver embodiment shown in FIG. 1, the louver vanes 34 are oriented substantially parallel to the face plate 40 to substantially inhibit fluid flow through the louver 20. The louver 20 shown in FIG. 1 is in a closed position. A perimeter of the face plate 40 may be larger than a perimeter of the first housing 36 and the second housing 38 so that the face plate of an assembled louver 20 covers and hides the first housing and the second housing.

Louver vanes 34, first housing 36, second housing 38, and face plate 40 may be made of any desired materials, such as but not limited to, metal, polymers, or combinations thereof. The metal may be, but is not limited to, sheet metal such as carbon steel or stainless steel. The polymers may be, but are not limited to, thermoset resins or thermoplastic resins. The thermoplastic resins may be, but are not limited to engineering resins, polyethylene, polypropylene, acrylonitrile-butadiene-styrene copolymer, polycarbonate or combinations thereof. Components of a louver 20 may be made of different materials. For example, the second housing 38 may be made of sheet metal while the first housing 36, louver vanes 34 and face plate 40 are formed of a polymer resin or resins. All or portions of polymer components may be formed of dyed resins and/or decorated resins. All or portions of polymer components may be hot stamped or metallized (e.g. with aluminum or chrome) to have the appearance of metal parts. Components of a louver 20 may be formed by any suitable process, such as but not limited to, prototype casting, epoxy casting from open face molds, die casting, injection molding, or reaction injection molding.

FIG. 2 and FIG. 3 show embodiments of a louver vane 34. A louver vane 34 may include pinion 42, raised surface 44 and blades 46. A pinion 42 of a louver vane 34 may fit within a rack formed by a first housing 36 and face plate 40 of a louver 20. Movement of the face plate 40 moves a portion of the rack and causes simultaneous rotation of all louver vanes 34. Rotation of the pinions 42 changes the orientation of the blades 46 of the louver vanes 34. Fluid passing through the louver 20 may exit the louver in a direction that is substantially parallel to a direction of orientation of the blades 46. When the blades 46 are oriented substantially parallel to the rack, as depicted in FIG. 1, fluid flow through the louver 20 may be inhibited.

A louver 20 may include two or more louver vanes 34. Each louver vane 34 of a louver 20 may be identical to other vanes of the louver. Having identical vanes 34 may simplify molds needed to produce vanes, may simplify assembling a louver, may simplify repairing a louver, and may limit a number of different inventory parts needed by an assembler or repairer of louvers. In some louver embodiments, some louvers may not be identical to other louver vanes. For example, end louver vanes may have wider blades than central louver vanes. Blades 46 of the louver vanes 34 may include tapered surfaces. The tapered surfaces may allow portions of the blades 46 to overlap without interference when the blades are oriented substantially parallel to a rack formed by a first housing 36 and face plate 40 of the louver 20.

A raised surface 44 of a louver vane 34 may be formed as a dome. A top of the raised surface 44 may contact side surfaces of a first housing 36 when the vane is positioned in a louver 20. The top of the raised surface 44 may not be in contact with side surfaces of the first housing 36 at all times. The raised surface 44 may inhibit vibrational movement of the vane 34 against the first housing 36. The raised surface 44 may inhibit generation of rattling or other noise during use. The raised surface 44 may also keep the vane 34 centrally located with a rack formed by a rack gear of a first housing and a rack gear of a face plate 40.

Louver vanes 34 may include pinions 42 at each end as illustrated in FIG. 2. The pinions 42 may be placed in racks formed by linear rack gears of a first housing 36 and linear rack gears of a face plate 40. When the face plate 40 is moved in the third direction 28 or the fourth direction 30, the vanes 34 may be rotated by interaction between the pinions 42 and the rack gears.

Figure 4:
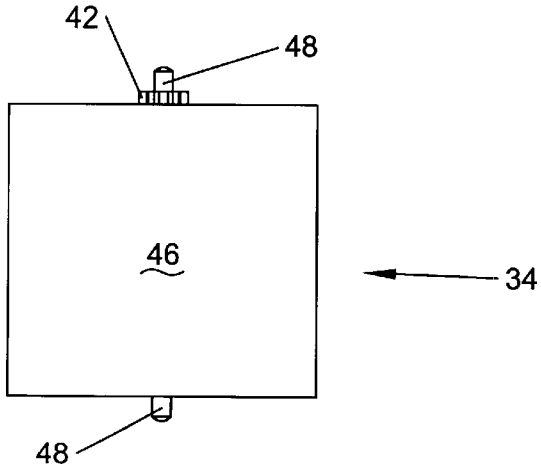
FIG. 4 shows an embodiment of a louver vane that has a single pinion.

FIG. 4 depicts an alternate embodiment of a louver vane 34. The louver vane 34 may include one pinion 42 and two axles 48. In an embodiment, the pinion 42 may be rotated by a rack gear of a face plate 40 when the face plate is laterally moved. Axles 48 of louver vanes 34 are positioned within recesses or within retainers of the first housing 36. The axles 48 rotate when the face plate is moved laterally. In an alternate embodiment, the pinion 42 may be rotated by a rack gear of a first housing 36 when the face plate 40 is laterally moved. Axles 48 of the louver vanes 34 are positioned within recesses or within retainers of the face plate 40. The axles 48 rotate when the face plate 40 is moved laterally.

In an alternate embodiment of a louver vane, the louver vane may include a pinion and an axle. The pinion may be placed in a rack formed by a rack gear of a first housing and a rack gear of a face plate. Louver axles 48 may be positioned in a gap between the first housing and the face plate, or in recesses or retainers of the face plate so that the axles laterally translate with the face plate when the face plate is laterally moved.

Figure 5:
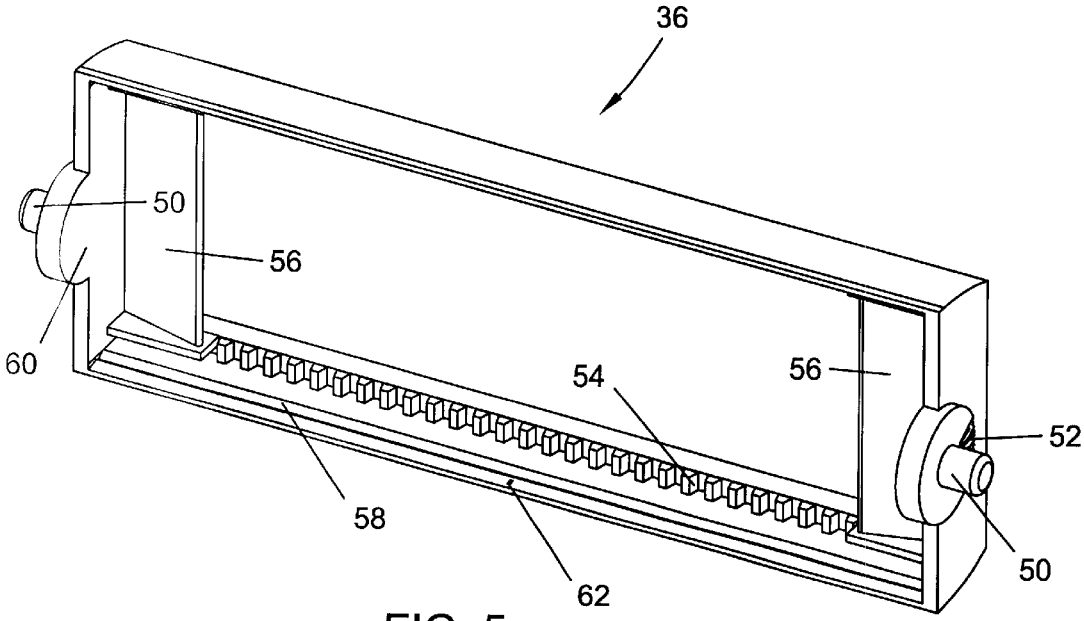
FIG. 5 shows a perspective view of an embodiment of a first housing of a louver.
Figure 6:
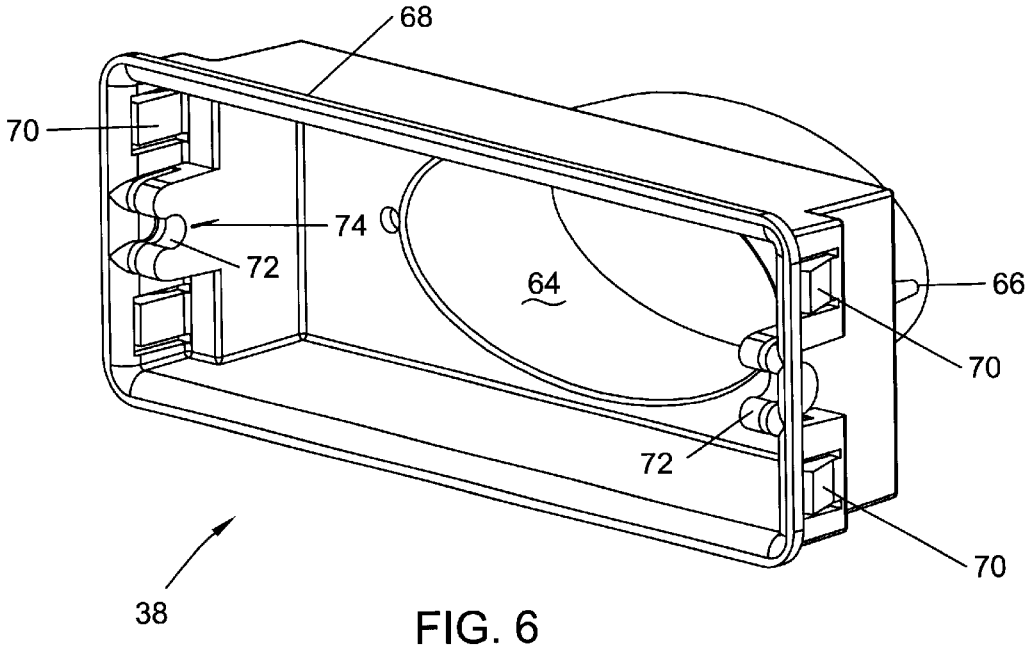
FIG. 6 shows a perspective view of an embodiment of a second housing of a louver.

FIG. 2 and FIG. 5 show embodiments of a first housing 36 of a louver 20. The first housing 36 may include mounting pins 50, radial grooves 52, rack gears 54, vane contact surfaces 56, face plate connector grooves 58, stop surface 60, and positioner 62. FIG. 2 and FIG. 6 show embodiments of a second housing 38 of a louver 20. A second housing 38 may include hose adapter 64, hose grips 66, lip 68, ventilation system mounts 70, first housing mounts 72, and protrusion 74.

First housing mounting pins 50 fit within housing mounts 72 of a second housing 38. When the first housing 36 is coupled to the second housing 38, the mounting pins 50 may allow the first housing to move in a first direction 24 or second direction 26 relative to the second housing (e.g. up and down) while inhibiting movement of the first housing in a third direction 28 and fourth direction 30 relative to the second housing (e.g. left and right).

A protrusion 74 of a second housing 38 may fit within one of the radial grooves 52 of the first housing 36. The radial grooves 52 may be formed radial to mounting pins 50 of the first housing 36. When the mounting pins 50 are coupled to the first housing mounts 72, the first housing 36 may be rotated relative to the second housing 38 to adjust direction of fluid passing through the louver in a first direction 24 or second direction 26. The first direction 24 may be up and the second direction 26 may be down relative to the second housing 38. The protrusion 74 of the second housing 38 may engage radial grooves 52 of the first housing 36 to form an interference fit that inhibits unintentional rotation of the first housing relative to the second housing. A height of the protrusion 74 and a depth of the radial grooves 52 may be sufficient to inhibit vibrations and small forces from rotating the first housing 36 relative to the second housing 38. The height of the protrusion 74 and depth of the radial grooves 52 may be sufficient to allow a user to provide enough force to overcome the interference fit so that the position of the first housing may be adjusted as desired in the first and second directions 24, 26. In an alternate louver embodiment, radial grooves may be formed on the second housing about a second housing mount, and a protrusion that engages the radial grooves may be formed on the first housing. In an alternate louver embodiment, the louver may not include radial grooves and/or protrusions that form an interference fit to inhibit unintentional rotation of the first housing relative to the second housing.

FIG. 1 depicts a louver 20 prior to connection of the louver to a ventilation system 22. Hose 76 of the ventilation system 22 may be coupled to the hose adapter 64. The hose 76 of the ventilation system 22 may direct fluid to the louver 20. Hose grips 66 on each side of the hose adapter 64 may hold the hose 76 on the hose adapter. A hose clamp, sealant or other fastener may be used in addition to, or in lieu of, the hose grips 66 to couple the hose 76 to the louver 20. After coupling the hose 76 to the hose adapter 64, the second housing 38 may be positioned in vent opening 78 of structure 32 (shown in FIG. 1) until lip 68 contacts the structure. The structure 32 may be any type of structure that the ventilation system 22 directs fluid through. If the ventilation system 22 is part of an automobile, the structure 32 may be a portion of a dashboard or console of the automobile. If the ventilation system 22 is a building ventilation system, the structure may be a wall, ceiling, or floor of a room. Ventilation system mounts 70 may be spring fasteners that hold the second housing to the structure 32 by formation of an interference fit with the structure. In some embodiments, screws, nuts and bolts, adhesive, sealant and/or other connectors may be used in conjunction with, or in lieu of, the ventilation system mounts 70 to couple the second housing 38 to the structure 32.

Figure 7:
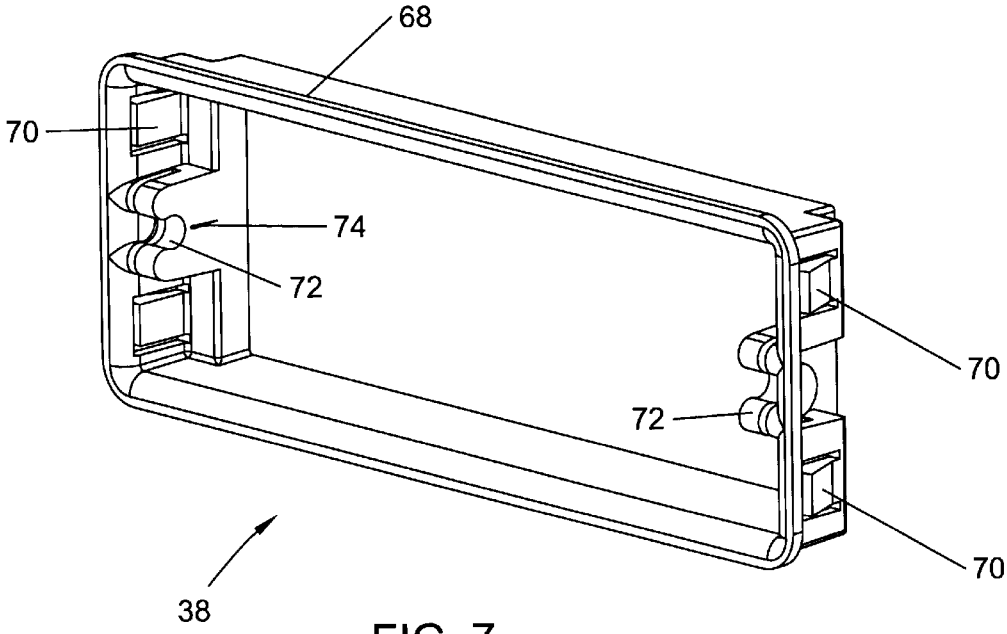
FIG. 7 shows a perspective view of an embodiment of a second housing of a louver, wherein the second housing does not include a ventilation hose mount.

In some ventilation system embodiments, a second housing 38 of a louver 20 may be placed directly into a ventilation duct, such as an air conditioning duct. FIG. 7 depicts an embodiment of a second housing that may be placed directly in a ventilation opening of a ventilation system. Fluid may be directed to the louver 20 through the ventilation duct instead of through a hose. A gasket or other type of sealant may be positioned between a lip 68 of the second housing 38 and structure defining an opening of the ventilation duct to form a seal between the louver 20 and the ventilation system. In other embodiments, a gasket or other type of seal may not be necessary. Spring mounts, screws or other fasteners may couple the second housing to the structure. In embodiments that do not require both axial and rotational louver movement, a first housing may include a lip, spring mounts or other type of fastening system that allows the first housing to be directly coupled to a ventilation opening of a ventilation system.

Figure 8:
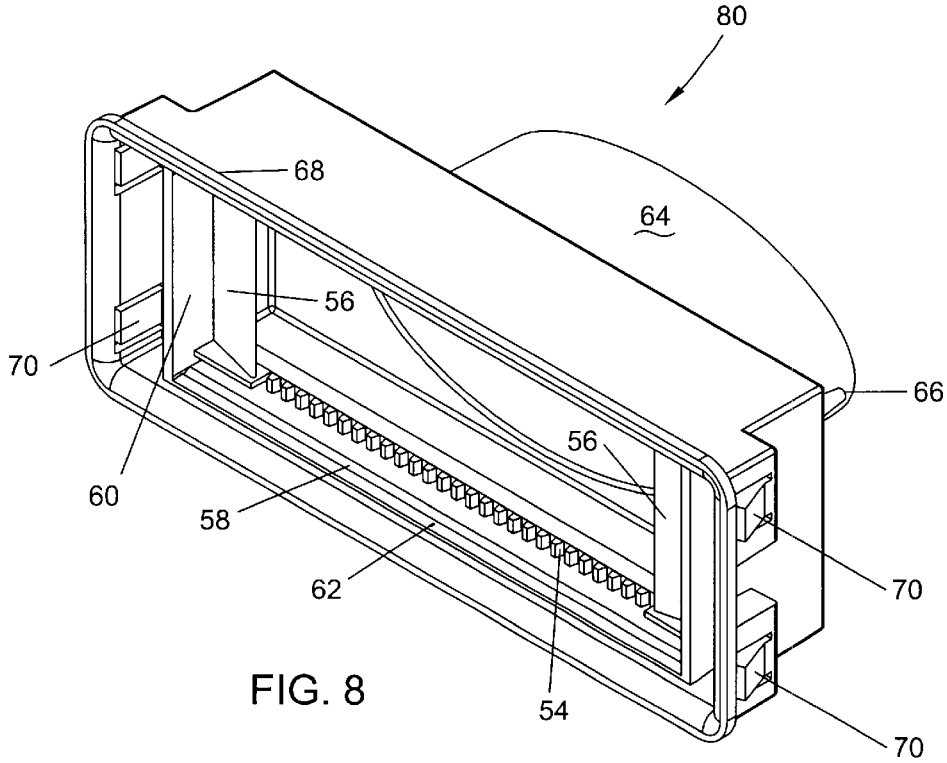
FIG. 8 shows a perspective view of an embodiment of an integrated first housing and second housing.

An embodiment of a louver may not include a first housing that allows adjustment of the louver in a first direction 24 and second direction 26 (directions indicated in FIG. 1). As shown in FIG. 8, a second housing and a first housing may be formed as a one-piece, integral housing 80. The integral housing 80 of the louver may include rack gears 54, vane contact surfaces 56, and face plate connector grooves 58. When a face plate and louver vanes are coupled to the housing 80, movement of the face plate allows adjustment of direction that fluid exits the louver in a third direction 28 or fourth direction 30. The housing 80 may not provide for adjustment of fluid flow in the first direction 24 and the second direction 26. The housing 80 may be formed in pieces. The pieces may be welded, sonically welded, glued, or otherwise coupled together to form the integral housing 80.

In some louver embodiments, a fluid tight seal may not be formed between vanes and the second housing. Some fluid flow through the louver may occur even when the face plate is fully extended in the third direction 28 or fourth direction 30.

A first housing 36 may include rack gears 54 that accepts pinions 42 of louver vanes 34. The pinions 42 may rotate along the linear rack gears 54. Rotation of the pinions 42 in the rack gears 54 allows the position of blades 46 of a louver 20 to be changed so that fluid passing through the louver may be directed in a desired direction that is substantially parallel to the orientation of the blades.

Pinions 42 of louver vanes 34 may be positioned in first housing rack gears 54 of a louver 20. A face plate 40 may include rack gears that mate with the pinions 42 and first housing rack gears 54 to form a rack and pinion system for simultaneously adjusting orientation of all louver vane blades 46 of the louver 20. The orientation of the louver vane blades 46 may be adjusted by laterally moving the face plate 40. When the face plate 40 is fully extended in a third direction 28 (directions indicated in FIG. 1), louver vane blades 46 may be oriented substantially parallel to the rack gears. A portion of a louver blade may overlap or abut a portion of an adjacent louver blade. A portion of a first end louver vane 34' (as shown in FIG. 2) may contact the top of a first louver contact surface 56', while a portion of a second end louver vane 34" may contact the bottom of a second louver contact surface 56". The first end louver vane 34', the second louver end vane 34", the first louver contact surface 56', and the second louver contact surface 56" are indicated in FIG. 2. In an alternate embodiment, the portion of the first end louver vane 34' may contact the first louver contact surface 56' and a portion of the second end louver vane 34" may abut the second louver contact surface 56". Fluid flow through the louver 20 may be substantially inhibited when the face plate 40 is fully extended in the third direction 28.

Moving the face plate 40 in a fourth direction 30 will rotate all of the louver vanes 34 simultaneously by interaction of the louver vane pinions 42 with the rack gears of the louver 20. When the face plate 40 is fully extended in the fourth direction 30, a portion of the first end louver vane 34' may abut the first louver contact surface 56', or contact the bottom of the first louver contact surface. A portion of the second louver vane 34" may contact the top of the second louver contact surface 56". Fluid flow through the louver 20 may be substantially inhibited when the face plate 40 is fully extended in the fourth direction 30. When the face plate is located in a position between full extension in the third direction 28 and full extension in the fourth direction 30, fluid flow may be directed through the louver 20 in a direction that is substantially parallel to an orientation of the louver vane blades.

Figure 9:
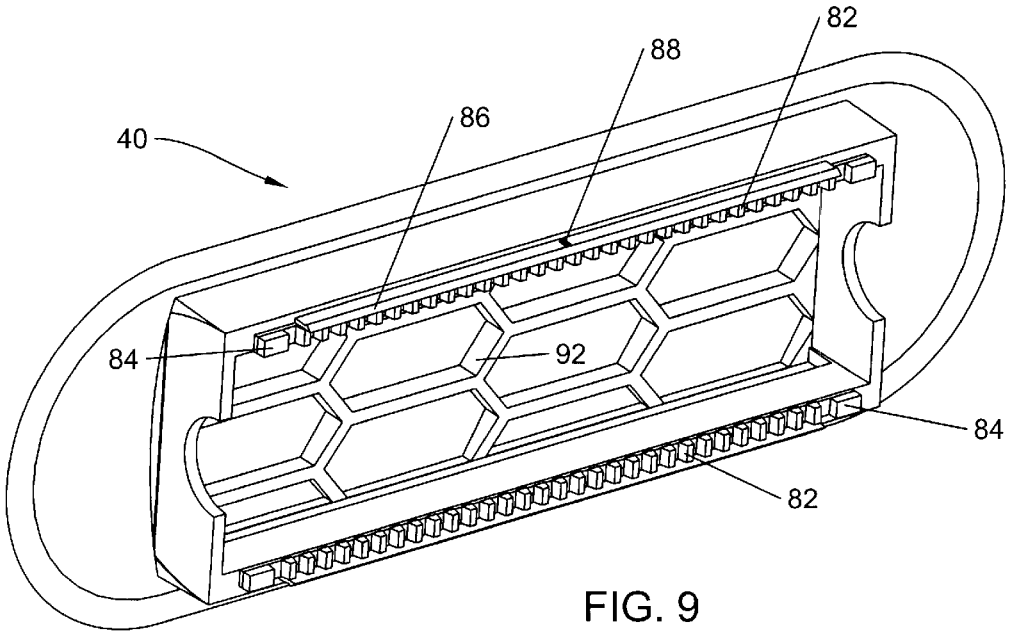
FIG. 9 shows a perspective view of an embodiment of a face plate that emphasizes a rear view of the face plate.

FIG. 9 shows a perspective view of a face plate 40 of a louver 20 that emphasizes a back view of the face plate. The face plate 40 may include rack gears 82, stops 84, spring lock 86, and positioner bumps 88. Rack gears 54 of a first housing 36 and the rack gears 82 of the face plate 40 may form a rack of a rack and pinion system. Pinions 42 of louver vanes 34 may be positioned in racks formed by rack gears 54, 82 of the first housing 36 and face plate 40. Movement of the face plate 40 in a third direction 28 or fourth direction 30 (shown in FIG. 1) relative to the first housing 36 may rotate the vanes 34 and allow adjustment of a direction that fluid exits the louver 20. An extent of movement of the face plate 40 in the third direction 28 or fourth direction 30 may be limited when a stop 84 of the face plate 40 contacts a stop surface 60 of a first housing 36. In some louver embodiments, a range of lateral movement of a face plate 40 is limited when a portion of a blade 46 of an end vane 34' or 34" touches a second housing vane contact surface 56' or 56'.

In some louver embodiments, vanes 34 of the louver 20 are oriented so that the louver blades 46 are not positionable substantially parallel to rack gears 54, 82 and such that louver blades do not overlap and/or abut when a face plate 40 of the louver is in a fully extended lateral position. For example, gaps through which fluid flows may exist between adjacent vanes 34 and between end vanes and contact surfaces 56 when the face plate 40 is fully laterally extended in a third direction 28 and/or fourth direction 30 (directions depicted in FIG. 1). Such louvers may allow fluid flow through the louver even when the face plate is fully extended in the third direction and/or fourth direction. In some louver embodiments, vanes 34 and rack gears 54, 82 of the louver 20 allow the louver to inhibit fluid flow through the louver when the face plate 40 is fully extended in the third direction 28 (or fourth direction) while allowing fluid to flow through the louver when the face plate is fully extended in the fourth direction 30 (or third direction).

Figure 10:
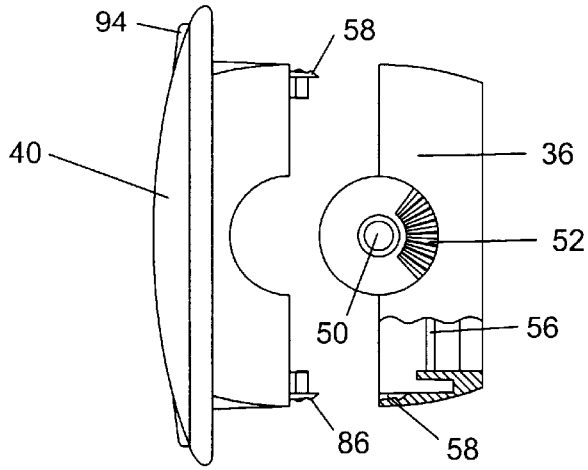
FIG. 10 shows a side view of an embodiment of a face plate that is adjacent to an embodiment of a first housing, wherein a portion of the first housing is shown in cross section to emphasize face plate connector grooves of the first housing.

FIG. 10 depicts a side view of a face plate 40 adjacent to a first housing 36. A portion of the first housing 36 is shown in cross section to emphasize a face plate connector groove 58. When a face plate 40 is attached to a first housing 36, removal of the face plate may be inhibited by face plate spring locks 86. Ends of the male spring locks 86 may extend into female face plate connector grooves 58 when the face plate is attached to the first housing 36. Engagement of an end of a spring lock 86 with a face plate connector groove 58 may inhibit removal of the face plate 40 from the first housing 36 while still allowing the face plate to be moved axially relative to the first housing. In some embodiments, removal of the face plate from the first housing may damage or break a portion of the spring lock. In other embodiments, the spring lock may have enough flexibility to allow the end portion of the spring lock to exit the face plate connector groove without damaging the spring lock.

Figure 11:
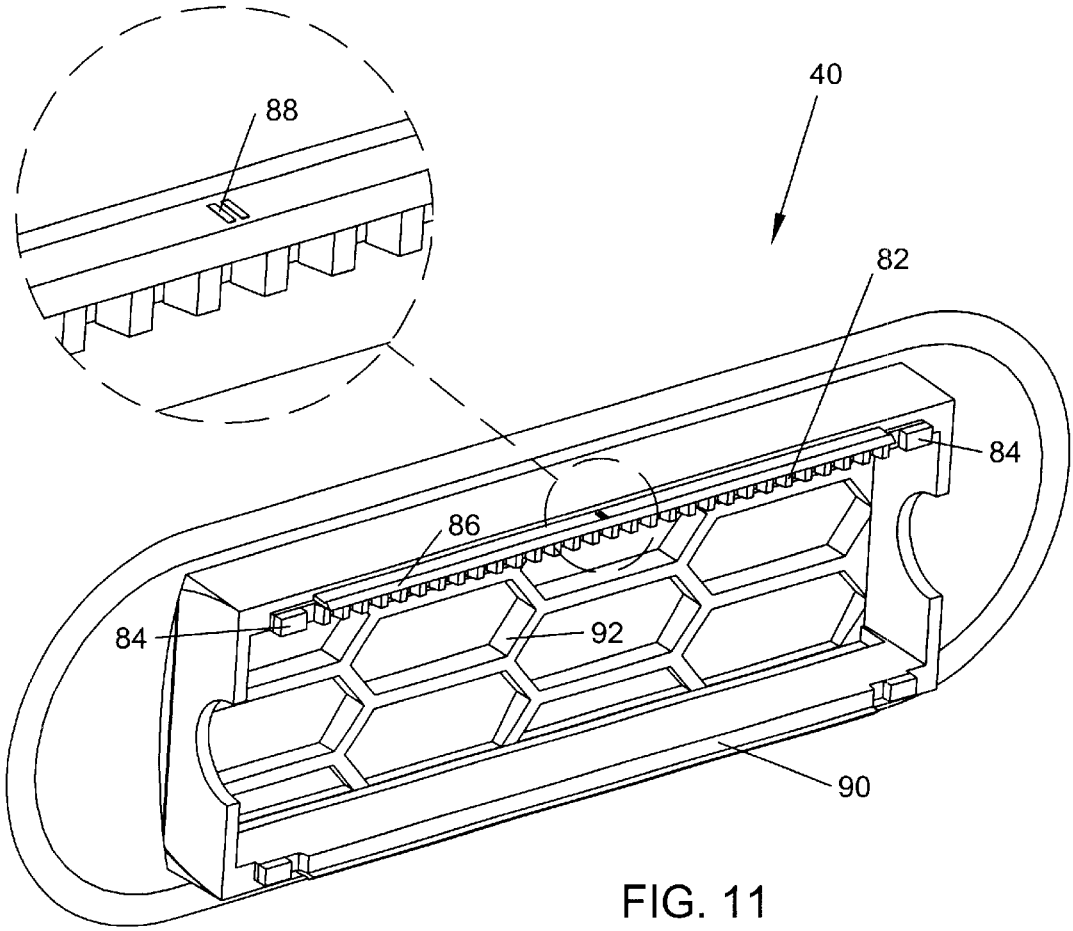
FIG. 11 shows a perspective view of an embodiment of a face plates including an inset view of a positioner, wherein the face plate includes a single rack gear.

A face plate 40 may include positioner 88. FIG. 11 shows an embodiment of a face plate 40 with an inset view of a positioner 88. The positioner 88 may be a bump or bumps on a surface of the face plate 40. Face plate positioner 88 may interact with a positioner 62 of a first housing 36. The positioner 62 of the first housing 36 may be a bump or bumps on a surface of the first housing. Engagement of the face plate positioner 88 with the first housing positioner 62 may indicate to a user that vanes 34 of a louver 20 are in a specific orientation. In an embodiment, the positioners 62, 88 may be engaged together when the face plate 40 is positioned at, or substantially at, a midpoint of the first housing 36. In some louver embodiments, the louvers may not include positioners.

In an embodiment of a louver 20, a positioning bump 62 on the first housing 36 is positioned between a pair of positioning bumps 88 on the face plate 40 when louver vanes 34 are oriented substantially perpendicular to a rack formed by face plate rack gear 82 and first housing rack gear 54. The positioning bump 62 on the first housing 36 may be positioned between a pair of positioning bumps 88 on the face plate 40 when the face plate is positioned substantially halfway between being filly extended in a third direction 28 and filly extended in a fourth direction 30 (directions shown in FIG. 1). When a user moves the face plate 40 to the halfway position, the user will feel engagement of the positioning bumps 88 of the face plate 40 with a positioning bump 62 of the first housing 36. The user will know that vanes 34 of the louver 20 are oriented substantially perpendicular to a rack, and thus to the face plate 40, when the face plate positioner 88 and first housing positioner 62 are in an engaged position. Fluid flow from the louver 20 may be directed substantially perpendicular to the face plate 40 when the bumps are in the engaged position. If the user desires to direct fluid flow from the louver 20 to the left, the user may move the face plate 40 to the left from the engaged position. Similarly, if the user desires to direct fluid flow from the louver 20 to the right, the user may move the face plate 40 to the right. In some louver embodiments, a face plate and a first housing may not include positioners.

A face plate 40 and/or louver 20 do not need to be oriented so that movement of the face plate causes change of the vane position that directs fluid right or left. For example, the louver 20 and face plate 40 may be oriented so lateral movement of the face plate causes vane 34 rotation that directs fluid up or down instead of right or left. Other orientations may also be established when a louver 20 is coupled to a ventilation system.

Figure 12:
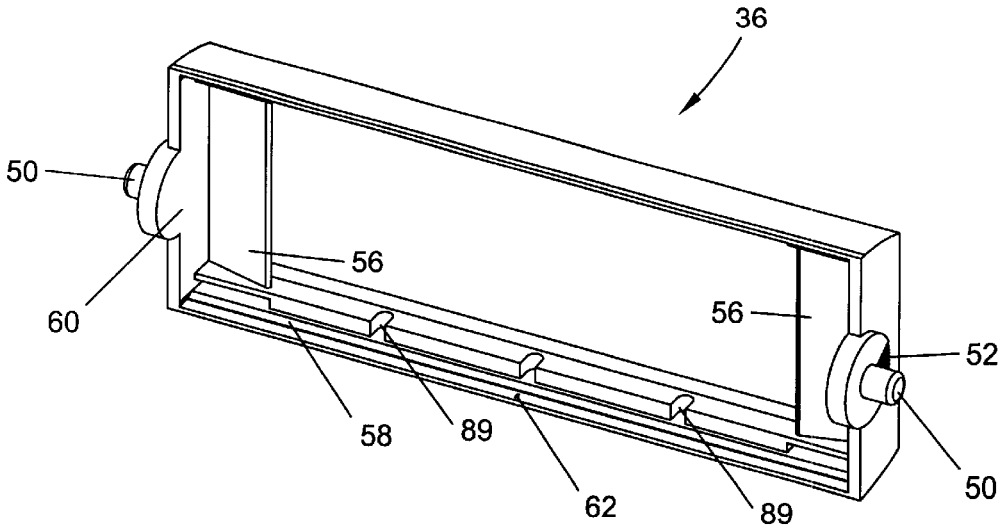
FIG. 12 shows a perspective view of an embodiment of a first housing that includes recesses for accepting axles of louver vanes.

FIG. 11 shows an embodiment of a face plate 40 that may be used with louver vanes 34 that have only a single pinion 42, such as the pinion depicted in FIG. 4. The face plate of FIG. 11 may be used with the first housing embodiment shown in FIG. 12. The first housing 36 may include recesses 89. The first housing 36 may not include a rack gear. Axles 48 of the louver vanes 34 may fit within the recesses 89. Upper axles above the pinions 42 may fit within openings formed in an upper portion of the first housing 36. The face plate 40 may include rack gear 82 and ridge 90. The ridge 90 may inhibit the louver vane axles 48 from moving out of the first housing recesses 89. When the face plate 40 is moved laterally, the rack gear 82 causes rotation of the louver vanes 34 with no translational change in position of the louver vanes relative to the first housing 36.

Figure 13:
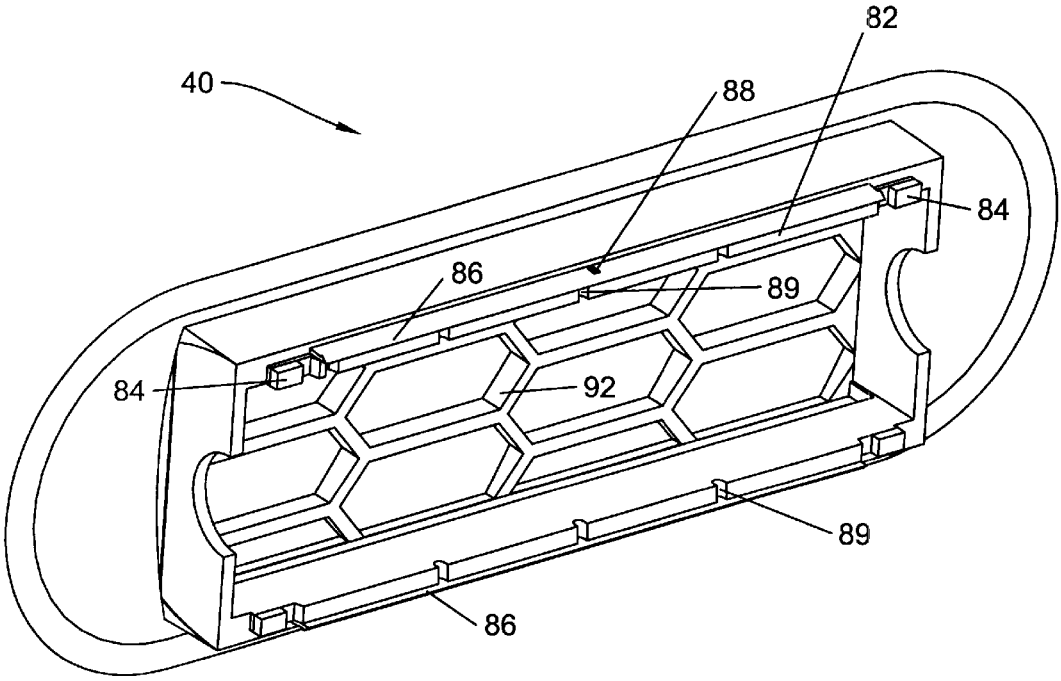
FIG. 13 shows a perspective view of an embodiment of a face plate that includes recesses for accepting axles of louver vanes.

FIG. 13 shows an embodiment of a face plate 40 having recesses for louver vane axles 48. A first housing 36 having ridges that hold the louver vanes 34 within recesses 89 would complement the face plate 40. The first housing 36 would also have a rack gear 54 that mates with pinions 42 of the louver vanes 34. When the face plate 40 of an assembled louver 20 is moved laterally with respect to the first housing 36, interaction of the face plate rack gear 54 with the pinions 42 would rotate the louver vanes 34. The louver vanes 34 would also move laterally along with the face plate 40.

Figure 14:
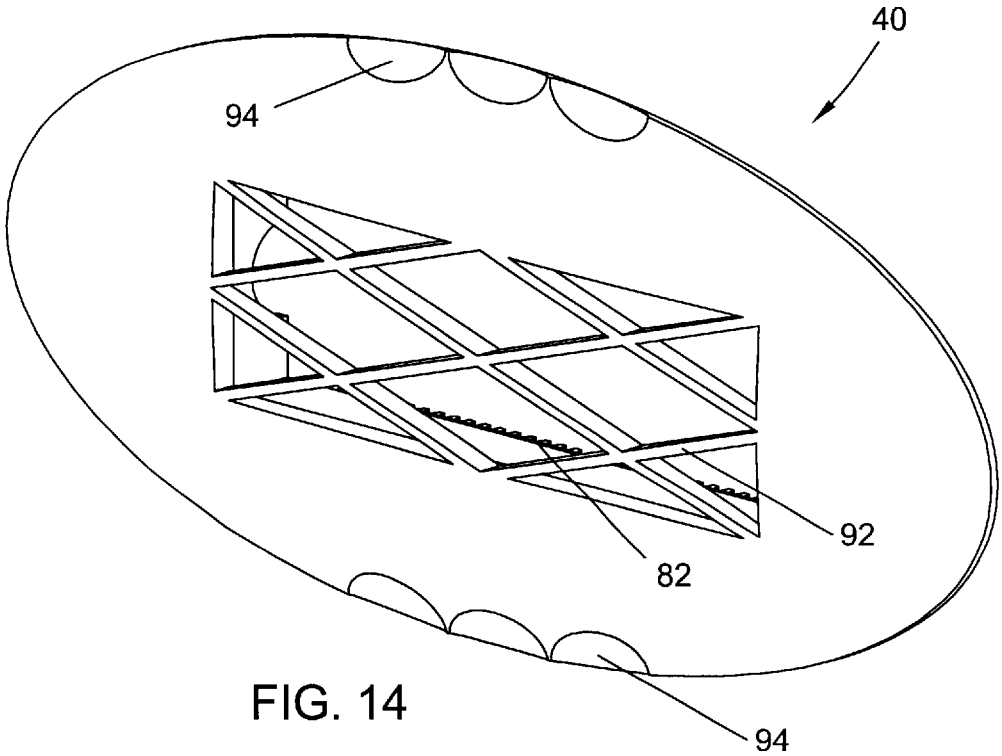
FIG. 14 shows a perspective view of an embodiment of a face plate that emphasizes a front view of the face plate.

FIG. 1 and FIG. 2 show perspective views of embodiments of face plates 40 for louvers 20. The figures emphasize front surfaces of the face plates. FIG. 14 shows a perspective view of an alternate embodiment of a face plate 40. A face plate 40 may include grid 92 and optional finger grips 94. The grid 92 may form a protective covering for vanes 34 of the louver 20. The grid 92 may also provide a grip surface that allows a user to move the face plate 40 in a first direction 24, second direction 26, third direction 28, and/or fourth direction 30 (directions shown in FIG. 1). Optional finger grips 94 may also provide grip surfaces that allow a user to move the face plate 40 in a desired direction or directions. The finger grips may be indentions in a surface of the face plate and/or the finger grips may be protrusions extending out of the face plate.

A front of a louver face plate 40 may be formed in any desired stylistic shape. The face plate figures show oblong and oval face plates, but face plates 40 may be formed in any desired shape. Face plate shapes may be, but are not limited to, round, oval, oblong, rectangular, and hexagonal. Different styles of face plates 40 may be coupled to a first housing 36 of a louver 20 without requiring modification of the first housing or louver vanes 34. A grid 92 and/or housing of a louver 20 may be made without an opening for an actuator that adjusts the position of louver vanes since the face plate will function as an actuator. In conventional louvers, an opening in a face plate or housing typically had to be provided to allow for adjustment of louver vanes. Such an opening and a mechanism to simultaneously move all vanes of the louver could make a conventional louver more time consuming, expensive and difficult to produce than a louver that uses movement of a face plate to adjust louver position.

To assemble a louver 20, components of the louver may be formed. Louver vanes 34 may be positioned within a rack formed by rack gears 54, 82 of a first housing 36 and a face plate 40 using a vane positioner.

Figure 15:
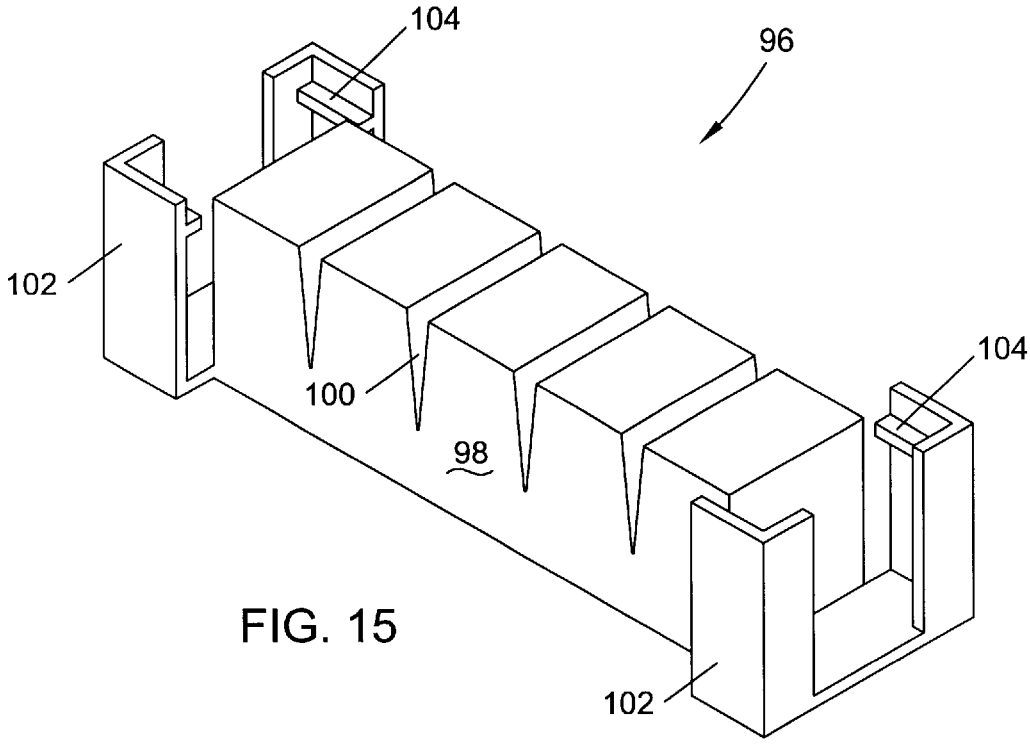
FIG. 15 depicts an embodiment of a vane positioner that may be used during assembly of a louver having four louver vanes.

FIG. 15 depicts an embodiment of vane positioner 96 for a four vane louver. Vane positioners adapted to hold more or less than four louver vanes may also be formed. The vane positioner 96 may include block 98, slots 100, face plate guides 102, and ledges 104. The block 98 may have a length and width that substantially corresponds to a length and width of an opening in a first housing 36 so that the block may be placed through the opening. Ledges 104 on the face plate guide 102 may support the first housing 36. Pinions 42 of louver vanes 34 may be placed in slots 100. When the louver vanes 34 are placed in the slots 100, louver vane pinions 42 may be positioned in rack gear 54 of the first housing 36. A face plate 40 may be positioned within the face plate guides and moved towards the first housing 36. Moving the face plate 40 towards the first housing 36 may position pinions42 in face plate rack gear 82. Moving the face plate 40 towards the first housing 36 may also allow face plate spring locks 86 to engage face plate connector grooves 58 of the first housing so that the face plate and the first housing are connected together. After the face plate 40 and the first housing are connected together, the resulting assembly of the face plate, louver vanes 34 and first housing may be removed from the vane positioner 96. Mounting pins 50 of the first housing 36 may be positioned in first housing mounts 72 of a second housing 38 to rotatively couple the first housing to the second housing and complete the assembly of the louver 20. In some vane positioner embodiments, the vane positioner may not include a face plate guide.

Figure 16:
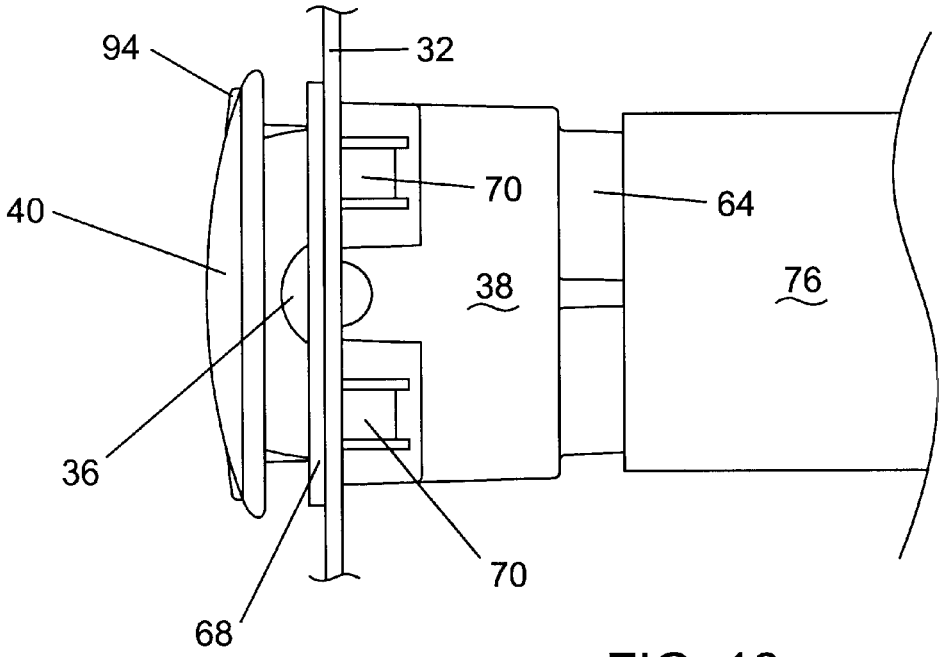
FIG. 16 shows a side view of a louver coupled to a structure and a portion of a forced fluid ventilation system.

A louver 20 may be coupled to a ventilation system 22. For example, a louver may be coupled to a ventilation system of an automobile. FIG. 16 shows a side view of an embodiment of a louver 20 coupled to a hose 76 of the ventilation system 22. The hose 76 of the ventilation system 22 may be connected to the hose adapter 64 of a second housing 38 of the louver 20. The second housing 38 may be positioned within an opening in a dashboard of the automobile. Second housing ventilation system mounts 70 may couple the louver 20 to the dashboard. Flow of air through the louver 20 may be blocked or directed in a desired direction by moving a face plate 40 of the louver. The face plate 40 may be rotated in a first direction 24 or second direction 26 to direct air flow through the louver upwards or downwards. Rotational motion of the face plate 40 may be limited by the face plate contacting a lip 68 of the second housing, by a portion of a first housing 36 contacting a portion of the second housing 38, or by other contact.

The face plate 40 may be moved fully in a third direction 28 or fourth direction 30 to the to substantially block air flow through the louver 20. The face plate 40 may be positioned between full extension to the left or full extension to the right to direct air flow in a desired direction. Engagement of a first housing positioner 62 with a face plate positioners 88 in a first position may indicate to a user when vanes of the louver are positioned substantially perpendicular to a rack such that air is directed substantially straight out of the louver 20. The face plate 40 may be moved left or right of the first position to direct air to the left or right. A user may contact grips 94, portions of grid 92, or edges of the face plate 40. The user may move the face plate 40 to direct fluid flowing through the louver 20 in a desired direction.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A louver comprising:

a first housing having at least one rack gear;

at least one vane, the vane having at least one pinion positioned in the at least one rack gear of the first housing;

a face plate movably coupled to the first housing, the face plate having at least one rack gear;

wherein the at least one pinion is positioned between the at least one rack gear of the first housing and the at least one rack gear of the face plate, and wherein movement of the face plate relative to the first housing rotates the at least one vane.

2. The louver of claim 1, wherein the first housing further comprises a mount, the mount configured to couple to a fluid line.

3. The louver of claim 1, wherein the at least one vane comprises two pinions, the first housing comprises two rack gears, and the face plate comprises two rack gears.

4. The louver of claim 1, wherein the at least one vane comprises a domed portion, the domed portion configured to contact a portion of the first housing.

5. The louver of claim 1, further wherein at least one spring lock movably couples the first housing to the face plate.

6. The louver of claim 1, further comprising a second housing, wherein the first housing is rotatively coupled to the second housing to allow rotational movement of the first housing relative to the second housing.

7. The louver of claim 6, wherein the second housing comprises a rotation inhibitor that interacts with the first housing to inhibit unintentional rotation of the first housing relative to the second housing.

8. The louver of claim 6, wherein the second housing comprises a mount, the mount configured to couple the second housing to a fluid line.

9. The louver of claim 1, wherein the face plate comprises a positioner that interacts with the first housing to indicate a position of the face plate relative to the first housing during use.

10. The louver of claim 1, wherein the at least one vane comprises a pinion at one end of the vane and an axle at a second end of the vane.

11. The louver of claim 1, wherein the at least one vane comprises two centrally aligned axles.

12. The louver of claim 1, wherein the at least one vane comprises a first pinion at one end of the vane and a second pinion at a second end of the vane.

13. The louver of claim 1, wherein the first housing comprises plastic.

14. The louver of claim 1, wherein the face plate comprises plastic.

15. The louver of claim 1, wherein a portion of the face plate is metallized.

16. The louver of claim 1, wherein the at least one vane comprises plastic.

17. The louver of claim 1, wherein a perimeter of the face plate is larger than a perimeter of the first housing.

18. A louver system comprising:

a first housing the first housing having at least one rack gear;

a face plate configured to be coupled to the first housing to allow the face plate to be sideways moved relative to the first housing,the face plate having at least one rack gear;

a plurality of vanes, each vane having at least one pinion, and wherein vane pinions are positionable in the at least one rack gear of the first housing and the at least one rack gear of the face plate such that movement of the face plate relative to the first housing rotates the plurality of vanes.

19. The system of claim 18, wherein the first housing comprises a mount, wherein the mount is configured to couple to a fluid line.

20. The system of claim 18, wherein at least one vane of the plurality of vanes comprises a domed portion configured to contact the first housing.

21. The system of claim 18, further comprising a second housing, wherein the second housing is configured to rotatively couple to the first housing.

22. The system of claim 21, further comprising a mount, the mount configured to couple to a fluid line.

23. The system of claim 21, wherein the second housing comprises a rotation inhibitor that interacts with the first housing to inhibit unintentional rotation of the first housing relative to the second housing.

24. The system of claim 18, wherein the face plate further comprises a position indicator that interacts with the first housing.

25. The system of claim 18, wherein each vane of the plurality of vanes comprises two pinions.

26. The system of claim 18, wherein each vane of the plurality of vanes are substantially identical.

27. The system of claim 18, wherein at least one vane of the plurality of vanes has a different blade width than a blade width of another vane of the plurality of vanes.

28. A louver comprising:

a first housing comprising a plurality of holders;

a face plate slidably coupled to the first housing, wherein the first housing comprises a rack gear;

a plurality of vanes, wherein each vane includes at least one pinion in working relation to the rack gear; and wherein each vane includes at least one axle configured to reside within a holder of the plurality of holders; and wherein sliding the face plate relative to the first housing rotates the vanes.

29. The louver of claim 28, wherein each vane of the plurality of vanes comprises two axles, and wherein the first housing comprises holders for each axle vane.

30. The louver of claim 28, wherein the plurality of holders comprise recesses in the first housing.

31. A louver comprising:

a first housing, wherein the first housing comprises a rack gear;

a face plate slidably coupled to the first housing, wherein the face plate comprises a plurality of holders;

a plurality of vanes, wherein each vane includes at least one pinion in working relation to the rack gear; and wherein each vane includes at least one axle configured to reside within a holder of the plurality of holders; and wherein sliding the face plate relative to the first housing rotates the vanes.

32. The louver of claim 31, wherein each vane of the plurality of vanes comprises two axles, and wherein the face plate comprises two rows of holders vane axles.

33. The louver of claim 28, wherein the plurality of holders comprise recesses in the face plate.

34. A method of forming a louver comprising:

placing pinions of a plurality of vanes in a rack gear of a first housing;

placing pinions of the plurality of vanes in a rack gear of a face plate;

coupling the first housing and the face plate together so that the vanes are positioned in a rack formed by the rack gear of the first housing and the rack gear of the face plate; and wherein the face plate is linearly movable relative to the first housing, and wherein movement of the face plate relative to the first gear rotates the vane pinions.

35. The method of claim 34, further comprising coupling the first housing to a second housing so that the first housing is rotatable relative to the second housing.

36. The method of claim 34, wherein placing pinions of the plurality of vanes in the rack gear of the first housing comprises placing an opening of the first housing around a vane positioner, and placing vanes in slots of the vane positioner so that pinions of the vanes are in the rack gear of the first housing.

37. The method of claim 36, wherein coupling the first housing and the face plate together comprises placing the face plate in a face plate guide of the vane positioner, moving the face plate towards the first housing so that a portion of the face plate engages a portion of the first housing.

* * * * *